US006872174B2

(12) United States Patent
Benach

(10) Patent No.: US 6,872,174 B2
(45) Date of Patent: Mar. 29, 2005

(54) ARM AND UPPER TORSO EXERCISE DEVICE

(75) Inventor: Anthony J. Benach, Portland, OR (US)

(73) Assignee: Tony Benach, Portland, OR (US)

( * ) Notice: Subject to any disclaimer, the term of this patent is extended or adjusted under 35 U.S.C. 154(b) by 0 days.

(21) Appl. No.: 10/444,182

(22) Filed: May 27, 2003

(65) Prior Publication Data

US 2004/0242387 A1 Dec. 2, 2004

(51) Int. Cl.[7] ..... A63B 21/02

(52) U.S. Cl. ..... 482/121; 482/122; 482/126; 482/128; 482/148

(58) Field of Search ..... 482/62, 907, 91, 482/140, 38, 126, 121, 122

(56) References Cited

U.S. PATENT DOCUMENTS

| | | | | | |
|---|---|---|---|---|---|
| 3,991,510 | A | * | 11/1976 | Bytheway | 446/489 |
| 4,623,146 | A | | 11/1986 | Jackson | 272/137 |
| 4,718,666 | A | | 1/1988 | O'Donnell et al. | 272/137 |
| 4,852,873 | A | * | 8/1989 | O'Donnell et al. | 482/126 |
| 5,004,226 | A | * | 4/1991 | Brown, Jr. | 482/126 |
| 5,022,648 | A | | 6/1991 | Travis | 272/137 |
| 5,147,262 | A | * | 9/1992 | Hymanson | 482/140 |
| 5,569,137 | A | | 10/1996 | Uen | 482/126 |
| 5,643,158 | A | | 7/1997 | Clementi | 482/45 |
| 5,741,207 | A | * | 4/1998 | Buoni et al. | 482/124 |
| 5,891,003 | A | * | 4/1999 | Deac et al. | 482/106 |
| 5,897,471 | A | * | 4/1999 | Multanen et al. | 482/44 |
| 6,022,302 | A | | 2/2000 | McBride | 482/128 |
| 6,244,998 | B1 | | 6/2001 | Hinds | 482/126 |
| 6,293,893 | B1 | * | 9/2001 | Truchelut | 482/121 |

* cited by examiner

*Primary Examiner*—Justine R. Yu
*Assistant Examiner*—L Amerson

(57) ABSTRACT

A flexible main member of tubular shape is provided with handgrips at its end segments enabling the user to exercise certain muscles by repeated manual flexing of the tube. The tube is of a fiber reinforced synthetic material. A cushion is affixed medially of the tube for contact with the user's body during use of the device.

2 Claims, 2 Drawing Sheets

ARM AND UPPER TORSO EXERCISE DEVICE

BACKGROUND OF THE INVENTION

The present invention concerns hand held, flexible devices against which manual forces are momentarily applied as a physical regimen.

The prior art, to the extent known, includes several exercise devices which utilize a spiral spring component, located between tubular segments each having a handgrip enabling flexure of the spring during various arm exercises. Other known exercise devices primarily for the arms include a molded rubber body which flexes during use.

The inclusion of a metal spring in an arm exercise device or the utilization of a molded resilient member in such a device contributes to the cost of manufacture and more importantly is not practical for exercising of large muscles of the upper torso. Accordingly such devices are not highly suitable for those wishing to warm up in preparing for a game of golf and who wish to warm up and stretch those muscles prior to play. Still further, such known devices do not lend themselves to unobtrusive transport in a golf bag by reason of weight, size and shape.

U.S. Pat. No. 4,623,146 discloses a device including a rigid tube 12 with handgrips 20 for imparting axial movements to the tube to alternately compress springs 38 confined within a tubular sleeve 28.

U.S. Pat. No. 4,718,666 discloses an upper body exercise device including a pair of rigid tubular members joined at their opposed ends by a central member 28 of elastomeric material which may be bent or twisted by manual forces. The resilient central member includes enlarged ends molded about end flanges 30 and 32 in place on the opposed ends of tube members 12 and 14.

U.S. Pat. No. 5,022,648 discloses an exercise device with tubular segments 14 and 16 with a helical spring and elastomeric shield thereabout disposed centrally of the device. A positionable internal member 28, upon relocation within tube segment 14, permits flexure of the helical spring upon displacement of the rigid tubular sections.

U.S. Pat. No. 5,569,137 discloses an exercise device wherein an elastic rope 5 is provided with handles at its ends with a resilient elongate cushion 32 disposed about rigid sleeve members 31. The sleeves are associated, one each with handgrips 4, to permit flexing of a helical spring 3 disposed within the elongate cushion. The sleeves 31 extend into each handgrip 4 and serve to receive opposite end segments of spring 3.

U.S. Pat. No. 5,643,158 discloses a device having a central cylindrical housing provided at its opposite ends with hand grips with an internal helical spring affixed to the hand grips whereby the user may impart torsional loads to the spring by oppositely directed forces applied about the axis of the spring.

U.S. Pat. No. 6,022,302 discloses a tubular member shaped to form handgrips at each of its ends with ends of the tubular segment press fitted into end segments of a coil spring and welded therein. A resilient elastomeric foam neck roll houses the spring and handle end segments therein. Flexure is limited to the spring component and the cushion in place thereabout.

U.S. Pat. No. 6,244,998 discloses a device having an elastic cord fitted at its ends with handgrips with a cylindrical pad carried by the cord. Provision is made for multiple elastic cords to be utilized by forces applied to the handgrips. The cylindrical pad isolates the elastic cord or cords of the device from contact with the body.

SUMMARY OF THE PRESENT INVENTION

The present invention is directed toward providing a tubular exercise device which flexes lengthwise during use.

A tubular main member of the device is of fiber reinforced material with handgrips at its ends. Forces applied to the handgrips in opposition to one another, originate in both torso and arm muscles as permitted by the elongate, flexible nature of the present device. Handgrips of the present device permit hand placement to determine the leverage required to flex the present device with flexure occurring lengthwise therealong.

The exercising device embodying the invention provides a lengthy radius of flexure for a wide range of travel especially suitable when major muscles of the upper torso are being exercised. For example, when the present device is supported at its midpoint as by travel of the user's neck, tubular end segments of the main member is along a lengthy radius of a couple of feet or so from the midpoint. Selective placement of a user's hand along a handgrip of the present device varies the effort required to reach the flexure sought. Grasping at one end permits additional use of the device as a walking stick.

The light weight of the present device and its linear shape facilitates carrying in a golf bag permitting warm up and stretching of a golfer immediately prior to starting a game of golf and at intervals during a game of golf, e.g., while waiting for other members of the group to tee off.

Utilization of a length of flexible tubing greatly simplifies the cost of manufacture and assembly effort by avoiding the interface between rigid tube members and an intermediate resilient member of metal or an elastomer.

DETAILED DESCRIPTION OF THE PREFERRED EMBODIMENTS

Figure 1:
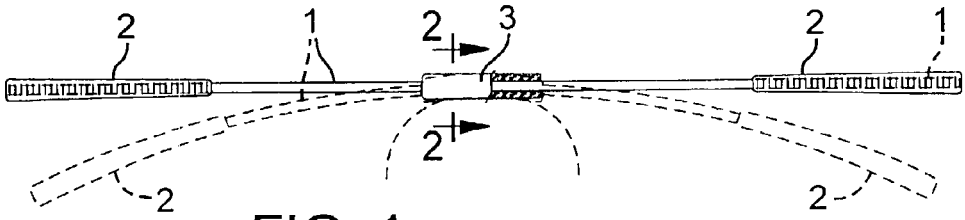
FIG. 1 is an elevational view of the present device.
Figure 2:
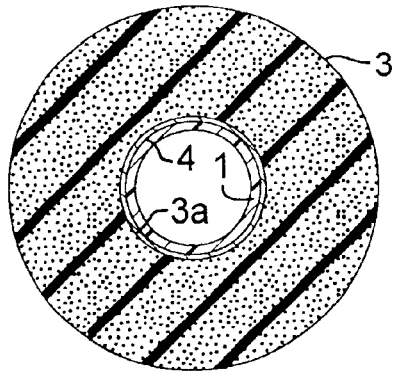
FIG. 2 is a sectional view taken along line 2—2 of FIG. 1.
Figure 3:
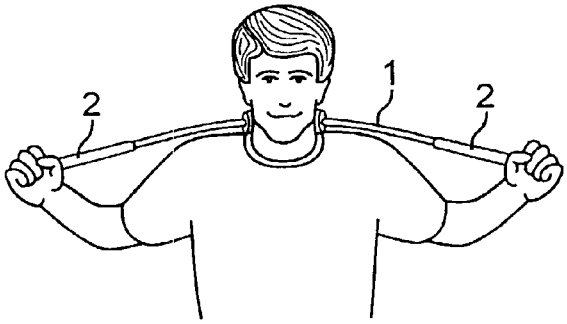
FIGS. 3–8 are views of the present device in use showing some of the exercise routines using the device.
Figure 4:
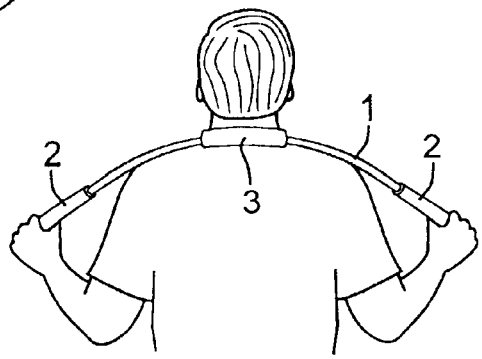
Figure 5:
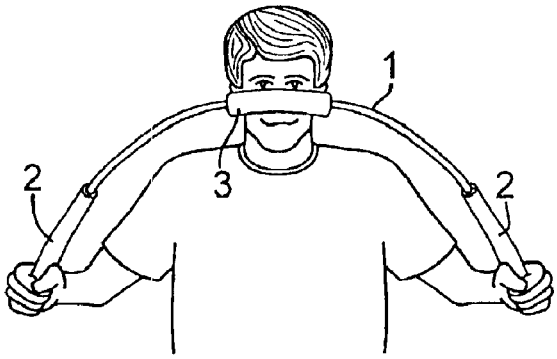
Figure 6:
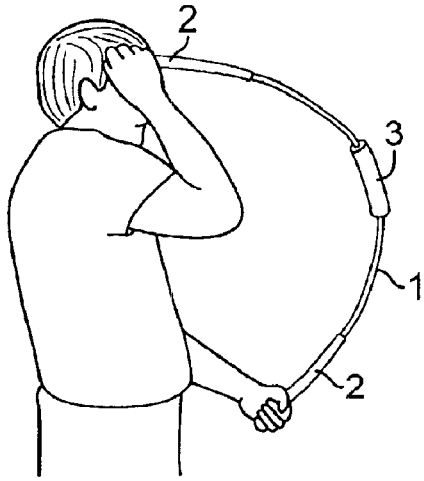
Figure 7:
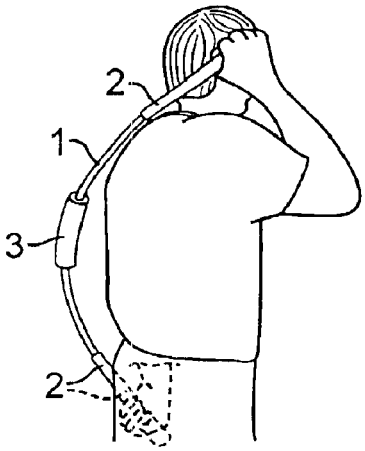
Figure 8:
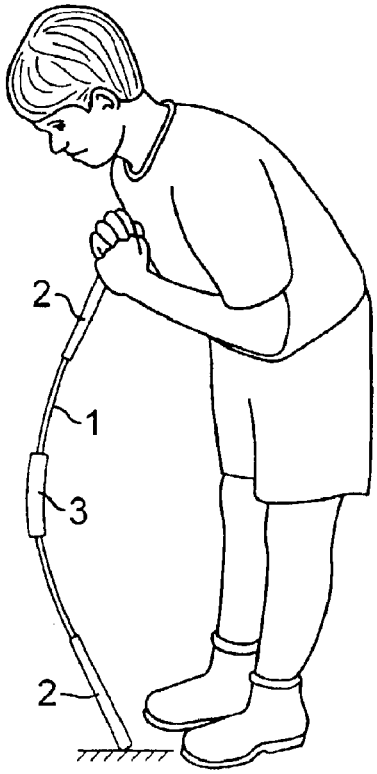

With continuing attention to the drawings wherein applied reference numerals indicate parts similarly hereinafter identified, the reference numeral 1 indicates the main body of the present device.

Main body 1 is of tubular linear configuration extending substantially the length of the device.

In place on end segments of main body 1 are handgrips at 2 which may be of molded resilient construction having an internal diameter for a snug fit with the main body. Preferably the handgrips are several inches in length to permit the user to selectively relocate his or her hand on segments thereof. If so desired the handgrips 2 may of course be of lesser length. Suitable for use as a handgrip are flexible molded grips of the general type found on golf clubs.

A cushion 3 on main body 1 is for contact with the neck, chest or back or other part of the user's body which serves as a fulcrum during an exercise. Cushion 3 preferably is of soft rubber with an opening 3A for passage of main body 1.

An adhesive 4 injected into the ends of cushion 3 and about segments of main body 1 serves to retain the cushion in place.

With further attention to main body 1, a suitable tubular structure is of an epoxy resin matrix with an OD of 0.505" and an ID of 0.417" with continuous fiber reinforcements, both longitudinal and circumferential resulting in a tube of high tensile and compressive flexural strength. Such tubing material is of less than one-eighth inch wall thickness with a suitable length of approximately three to four feet.

Tubing manufactured by Glasforms, Inc. of San Jose, Calif. and Birmingham, Ala. has proved satisfactory. Tube lengths and diameters may vary to provide a device for use by individuals with different upper body and arm strengths. For example, the present device may include a main member 1 having an outside diameter of 0.3750" and of lesser overall length than the first described form.

During use of the present device, main body 1 will flex along its length in a uniform manner.

While I have disclosed but a few embodiments of the invention, it will be apparent to those skilled in the art that the invention may be embodied still otherwise without departing from the spirit and scope of the claimed invention.

Having thus described the invention, what is desired to be secured by a Letters Patent is:

I claim:

1. A flexible tubular stretching device for exercising a person's upper torso and arm muscles consisting of:

A main body having a linear configuration extending substantially the length of said device, said main body comprising a multi-ply electrically insulated composite of continuous plastic fiber reinforcements in an epoxy resin matrix, said body including alternating longitudinal and circumferential filament layers for maintaining high tensile and compressive flexural strength;

A pair of flexible handgrips affixed at opposite ends of said device, said handgrips having a molded resilient construction;

A cushion affixed to a medial segment of said device;

An adhesive injected into said cushion for retaining the placement of said cushion on said device.

2. The device claimed in claim 1 wherein said handgrips are each of a length having multiple segments, each of said segments of a length to receive a user's hand.

* * * * *